US012410559B2

(12) United States Patent
Magnusson

(10) Patent No.: US 12,410,559 B2
(45) Date of Patent: Sep. 9, 2025

(54) PRODUCTION METHOD

(71) Applicant: Billerudkorsnas AB, Solna (SE)

(72) Inventor: Johan Magnusson, Frovi (SE)

(73) Assignee: BILLERUDKORSNAS AB, Solna (SE)

( * ) Notice: Subject to any disclaimer, the term of this patent is extended or adjusted under 35 U.S.C. 154(b) by 666 days.

(21) Appl. No.: 17/440,286

(22) PCT Filed: Mar. 20, 2020

(86) PCT No.: PCT/EP2020/057896

§ 371 (c)(1),
(2) Date: Sep. 17, 2021

(87) PCT Pub. No.: WO2020/188112

PCT Pub. Date: Sep. 24, 2020

(65) Prior Publication Data

US 2022/0154399 A1 May 19, 2022

(30) Foreign Application Priority Data

Mar. 20, 2019 (SE) ..... 1950349-9

(51) Int. Cl.

| | |
|---|---|
| ***D21D 1/26*** | (2006.01) |
| ***D21H 11/02*** | (2006.01) |
| ***D21H 11/18*** | (2006.01) |
| ***D21H 27/30*** | (2006.01) |

(52) U.S. Cl.

CPC ..... *D21D 1/26* (2013.01); *D21H 11/02* (2013.01); *D21H 11/18* (2013.01); *D21H 27/30* (2013.01)

(58) Field of Classification Search

CPC ..... D21H 11/02; D21H 11/18; D21H 27/30; D21D 1/26; D21D 21/20; D21C 9/007

See application file for complete search history.

(56) References Cited

U.S. PATENT DOCUMENTS

| | | | | |
|---|---|---|---|---|
| 7,398,938 | B2 * | 7/2008 | Antensteiner | B02C 2/10 241/296 |
| 9,175,441 | B2 * | 11/2015 | Heiskanen | D21H 19/18 |
| 9,988,762 | B2 * | 6/2018 | Bilodeau | D21D 1/306 |
| 10,400,393 | B2 * | 9/2019 | Hawén | D21D 1/22 |
| 10,767,312 | B2 * | 9/2020 | Karisalmi | D21H 11/12 |

(Continued)

FOREIGN PATENT DOCUMENTS

| | | | | |
|---|---|---|---|---|
| CA | 2534256 C | * | 5/2013 | B02C 2/10 |
| CN | 108130781 A | | 6/2018 | |

(Continued)

*Primary Examiner* — Jose A Fortuna

(74) *Attorney, Agent, or Firm* — Stites & Harbison PLLC; Richard S. Myers, Jr.

(57) ABSTRACT

There is provided a method of producing a highly refined pulp, comprising the steps of: providing a pulp; subjecting the pulp to a first conical refining step in at least one conical refiner comprising refining plates having a bar width of 0.5-1.5 mm, such as about 1.0 mm, and a groove width of 1.0-2.0 mm, such as 1.4-2.0 mm, such as about 1.6 mm; and subjecting the pulp from the first conical refining step to a second conical refining step in at least one conical refiner comprising refining plates having a bar width of 0.5-1.5 mm, such as about 1.0 mm, and a groove width of 0.8-1.6 mm, such as 1.0-1.5 mm, to obtain the highly refined pulp.

27 Claims, 2 Drawing Sheets

(56) References Cited

U.S. PATENT DOCUMENTS

| | | | | |
|---|---|---|---|---|
| 10,954,417 | B2 * | 3/2021 | Sumnicht | C09J 101/02 |
| 10,975,499 | B2 * | 4/2021 | Pande | D01B 9/00 |
| 11,131,062 | B2 * | 9/2021 | Karisalmi | D21H 17/33 |
| 11,479,917 | B2 * | 10/2022 | Miikki | B32B 27/32 |
| 11,982,053 | B2 * | 5/2024 | Gingras | B02C 7/12 |
| 2006/0113415 | A1 | 6/2006 | Antensteiner | |
| 2012/0241114 | A1 * | 9/2012 | Axrup | D21H 17/28 162/127 |
| 2022/0154399 | A1 * | 5/2022 | Magnusson | D21D 1/26 |
| 2022/0333314 | A1 * | 10/2022 | Langford | D21H 17/71 |
| 2022/0356648 | A1 * | 11/2022 | Pande | D21D 99/00 |
| 2024/0003092 | A1 * | 1/2024 | Heiskanen | D21H 27/30 |

FOREIGN PATENT DOCUMENTS

| | | | | | |
|---|---|---|---|---|---|
| CN | 113710847 | B | * | 8/2023 | D21C 9/007 |
| EP | 2220291 | B1 | * | 5/2017 | B02C 7/12 |
| EP | 3581707 | A1 | * | 12/2019 | B02C 7/12 |
| EP | 3350368 | B1 | * | 11/2020 | D21C 9/00 |
| EP | 3287564 | B1 | * | 4/2021 | D01B 9/00 |
| EP | 4148182 | A1 | * | 3/2023 | D21C 9/007 |
| EP | 3942107 | B1 | * | 5/2023 | D21C 9/007 |
| WO | WO2012101330 | A1 | | 8/2012 | |
| WO | WO-2014029917 | A1 | * | 2/2014 | D21F 11/04 |
| WO | WO-2015171714 | A1 | * | 11/2015 | D21C 9/007 |
| WO | WO2016/140609 | A1 | | 9/2016 | |
| WO | WO-2018110855 | A1 | * | 6/2018 | B02C 7/12 |
| WO | WO-2021209916 | A1 | * | 10/2021 | B32B 27/10 |
| WO | WO-2022049482 | A1 | * | 3/2022 | D21F 11/08 |

* cited by examiner

PRODUCTION METHOD

CROSS REFERENCE TO RELATED APPLICATIONS

This application is a § 371 National State Application of PCT/EP2020/057896 filed Mar. 20, 2020, which claims priority to SE 1950349-9 filed Mar. 20, 2019.

TECHNICAL FIELD

The present disclosure relates to the field of producing a highly refined pulp.

BACKGROUND

It is well known in the prior art to produce "microfibrillated cellulose" (MFC) or "nanocellulose" by passing preferably pretreated pulp through a homogenizer. Further, the prior art discusses various applications of the MFC or nanocellulose, including use as an additive in or between layers of multi-layered paperboard.

SUMMARY

The present inventor has realized that a method relying on a homogenizer as well as many other prior art methods for producing MFC or nanocellulose are too expensive because of high investment costs and excessive energy consumption. The present inventor has also realized that the degree of fibrillation in the MFC and nanocellulose produced by many of the prior art methods is higher than what is needed when the product is used as an additive in a CTMP-containing middle layer of multi-layered paperboard or to adhere paperboard layers to each other.

An object of the present disclosure is thus to provide an energy-efficient method of producing a highly refined pulp that can be used as an additive in a process of producing paperboard. It is another object of the present disclosure that this method can be based on equipment that is already available in many mills for producing paperboard.

An itemized listing of embodiments of the present disclosure is provided below.

1. A method of producing a highly refined pulp, comprising the steps of:
   providing a pulp;
   subjecting the pulp to a first conical refining step in a conical refiner comprising refining plates having a bar width of 0.5-1.5 mm, such as about 1.0 mm, and a groove width of 0.5-1.5 mm, such as about 1.0 mm; and
   subjecting the pulp from the first conical refining step to a second conical refining step in at least one conical refiner comprising refining plates having a bar width of 0.4-1.0 mm, such as 0.5-1.0 mm, such as about 0.6 mm, and a groove width of 0.4-1.0 mm, such as 0.5-1.0 mm, such as about 0.6 mm, to obtain the highly refined pulp.
2. The method according to item 1, wherein the bar width of the second conical refining step is smaller than the bar width of the first conical refining step.
3. The method according to item 1 or 2, wherein the groove width of the second conical refining step is smaller than the groove width of the first conical refining step.

4. The method according to any one of the preceding items, wherein the bar height of the first conical refining step is 3-10 mm, such as 5-6 mm.
5. The method according to any one of the preceding items, wherein the bar height of the second conical refining step is 3-10 mm, such as 5-6 mm.
6. The method according to any one of the preceding items, wherein the consistency of the pulp in the first and the second conical refining step is 2-5%, such as about 4%.
7. The method according to any one of the preceding items, wherein the rotational speed is higher in the second conical reefing step than in the first conical refining step.
8. The method according to any one of the preceding items, wherein the flow through the conical refiner in the first conical refining step is 20-70 l/s.
9. The method according to any one of the preceding items, wherein the flow through the at least one conical refiner in the second conical refining step is 20-70 l/s.
10. The method according to any one of the preceding items, wherein the specific edge load (SEL) is lower for the second conical refining step than for the first conical refining step.
11. The method according to any one of the preceding items, wherein the pulp is pretreated with alkali before the first conical refining step.
12. The method according to item 11, wherein the pH of the pulp in the alkali pretreatment is in the range of 8-11.
13. The method according to any one of the preceding items, wherein the pulp is pretreated with enzymes before the first conical refining step.
14. The method according to any one of items 11-13, wherein the pretreatment is carried out in a pretreatment vessel and wherein the average retention time of the pulp in the pretreatment vessel is between 20 min and 3 h, such as about 2 h.
15. The method according to any one of the preceding items, wherein the pulp is pre-refined before the first conical refining step.
16. The method according to item 15, wherein the pre-refining is low consistency (LC) refining.
17. The method according to any one of the preceding items, wherein the pulp is unbleached softwood pulp, bleached softwood pulp or bleached hardwood pulp, such as bleached birch pulp.
18. The method according to any one of the preceding items, wherein the first conical refining step comprises cooling of pulp that has been refined in the conical refiner.
19. The method according to any one of the preceding items, wherein the second conical refining step comprises cooling of pulp that has been refined in the least one conical refiner.
20. The method according to any one of the preceding items, wherein vibrations of the conical refiner of the first conical refining step is sensed and the load applied in the conical refiner of the first conical refining step is controlled in response to the sensed vibrations.
21. The method according to any one of the preceding items, wherein vibrations of a conical refiner of the second conical refining step is sensed and the load applied in the conical refiner is controlled in response to the sensed vibrations.
22. The method according to any one of the preceding items, wherein:

the first conical refining step comprises circulating the pulp from a first tank, through the conical refiner and back to the first tank; and/or the second conical refining step comprises circulating the pulp from a second tank, through the at least one conical refiner and back to the second tank.

23. The method according to item 22, wherein a lower portion of the second tank has a conical shape and wherein an outlet is provided at the bottom of the second tank.

24. The method according to item 22 or 23, wherein the pulp in the second tank is agitated by vertical circulation.

25. The method according to any one of the preceding items, wherein the method is continuous.

26. The method according to item 25, wherein the rate of net energy transfer to the fibers of the pulp in the conical refiner of the first conical refining step is 500-1000 kW, such as 600-950 kW.

27. The method according to item 25 or 26, wherein the rate of net energy transfer to the fibers of the pulp in the at least one conical refiner of the second conical refining step is 500-1000 kW, such as 600-950 kW.

28. The method according to item 22 and 25, wherein, in the first conical refining step, the flow through the conical refiner is higher than the flow to the second conical refining step.

29. The method according to item 22 and 25, wherein, in the second conical refining step, the flow through the at least one conical refiner is higher than the flow of highly refined pulp from the second conical refining step.

30. The method according to any one of items 25-29, wherein the average retention time of the pulp in the first conical refining step is about 1 h and/or wherein the average retention time of the pulp in the second conical refining step is about 1 h.

31. The method according to any one of items 1-24, wherein the method is batch-wise.

32. The method according to item 31, wherein the rate of net energy transfer to the fibers of the pulp in the conical refiner of the first conical refining step is gradually decreased from a level of 900-1300 kW, such as about 1100 kW.

33. The method according to item 31 or 32, wherein the rate of net energy transfer to the fibers of the pulp in the at least one conical refiner of the second conical refining step is gradually decreased from a level of 900-1300 kW, such as about 1100 kW.

34. The method according to any one of items 31-33, wherein the retention time of the pulp in the first conical refining step is about 1 h and/or wherein the retention time of the pulp in the second conical refining step is about 1 h.

35. The method according to any one of the preceding items, wherein the net energy supply in the conical refiner of the first conical refining step is 300-1000 kWh/tonne dry fibers, such as 300-700 kWh/tonne dry fibers.

36. The method according to any one of the preceding items, wherein the net energy supply in the at least one conical refiner of the second conical refining step is 300-1000 kWh/tonne dry fibers, such as 300-700 kWh/tonne dry fibers.

37. The method according to any one of the preceding items, further comprising measuring a crill value and/or a fiber length value of the pulp and controlling a step of the method in response to the crill value and/or the fiber length value.

38. The method according to any one of the preceding items, further comprising the step of adding the highly refined pulp to a pulp for making paperboard and subsequently forming a middle layer of a multi-layered paperboard from a furnish comprising the pulp for making paperboard.

39. The method according to item 38, wherein the furnish comprises CTMP.

40. The method according to item 38, wherein the pulp for making paperboard comprises or consists of CTMP.

41. The method according to item 40, wherein the pulp for making paperboard is subjected to refining after the highly refined pulp has been added to it.

42. The method according to any one of the preceding items, further comprising the step of providing the highly refined pulp between two layers in a production of a multi-layered paperboard.

43. The method according to item 42, wherein the highly refined pulp is added to one of the two layers by spraying or by means of a headbox.

44. A system for producing a highly refined pulp, comprising:

a first refining arrangement comprising a conical refiner comprising refining plates having a bar width of 0.5-1.5 mm, such as about 1.0 mm, and a groove width of 0.5-1.5 mm, such as about 1.0 mm; and a second refining arrangement comprising at least one conical refiner comprising refining plates having a bar width of 0.4-1.0 mm, such as 0.5-1.0 mm, such as about 0.6 mm, and a groove width of 0.4-1.0 mm, such as 0.5-1.0 mm, such as about 0.6 mm, wherein the second refining arrangement is connected to and arranged downstream of the first refining arrangement.

45. The system according to item 44, wherein the bar width in the second refining arrangement is smaller than the bar width in the first refining arrangement.

46. The system according to item 44 or 45, wherein the groove width in the second refining arrangement is smaller than the groove width in the first refining arrangement.

47. The system according to any one of items 44-46, wherein the bar height in the first refining arrangement is 3-10 mm, such as 5-6 mm.

48. The system according to any one of items 44-47, wherein the bar height in the second refining arrangement is 3-10 mm, such as 5-6 mm.

49. The system according to any one of items 44-48, further comprising a dosing tank connected to and arranged upstream of the first refining arrangement.

50. The system according to item 49, further comprising at least one pre-refiner connected to and arranged upstream of the dosing tank.

51. The system according to item 50, wherein the at least one pre-refiner is at least one low consistency (LC) refiner.

52. The system according to any one of item 44-51, wherein the first refining arrangement comprises a cooler for cooling pulp.

53. The system according to any one of item 44-52, wherein the second refining arrangement comprises a cooler for cooling pulp.

54. The system according to any one of item 44-53, wherein the conical refiner of the first refining arrangement comprises a sensor for sensing vibrations, which sensor can produce a signal that can be used to adjust the load applied in the conical refiner.

55. The system according to any one of item 44-54, wherein a conical refiner of the second refining arrangement comprises a sensor for sensing vibrations, which sensor ca produce a signal that can be used to adjust the load applied in the conical refiner.

56. The system according to any one of item 44-55, wherein the first refining arrangement comprises a first tank having a tank outlet and a tank inlet, wherein the tank outlet is connected to an inlet of the conical refiner of the first refining arrangement and the tank inlet is connected to an outlet of the conical refiner of the first refining arrangement.

57. The system according to any one of item 44-56, wherein the second refining arrangement comprises a second tank having a tank outlet and a tank inlet, wherein the tank outlet is connected to an inlet of the at least one conical refiner of the second refining arrangement and the tank inlet is connected to an outlet of the at least one conical refiner of the second refining arrangement.

58. The system according to item 57, wherein a lower portion of the second tank has a conical shape and wherein the tank outlet is provided at the bottom of the second tank.

59. The system according to item 58, wherein the second tank comprises means for vertical circulation.

60. The system according to any one of item 44-59, further comprising a tank connected to and arranged downstream of the second refining arrangement.

61. A method of producing a highly refined pulp, comprising the steps of:

providing a pulp;

subjecting the pulp to a first conical refining step in at least one conical refiner comprising refining plates having a bar width of 0.5-1.5 mm, such as about 1.0 mm, and a groove width of 1.0-2.0 mm, such as 1.4-2.0 mm, such as about 1.6 mm, provided that the groove width is greater than the bar width; and subjecting the pulp from the first conical refining step to a second conical refining step in at least one conical refiner comprising refining plates having a bar width of 0.5-1.5 mm, such as about 1.0 mm, and a groove width of 0.8-1.6 mm, such as 1.0-1.5 mm, to obtain the highly refined pulp.

62. The method according to item 61, wherein the groove width of the second conical refining step is smaller than the groove width of the first conical refining step.

63. The method according to item 61 or 62, wherein the bar width of the second conical refining step is about the same as the bar width of the first conical refining step.

64. The method according to any one of the preceding items 61-63, wherein the bar height of the first conical refining step is 3-10 mm, such as 5-6 mm.

65. The method according to any one of the preceding items 61-64, wherein the bar height of the second conical refining step is 3-10 mm, such as 5-6 mm.

66. The method according to any one of the preceding items 61-65, wherein the consistency of the pulp in the first and the second conical refining step is 2-5%, such as about 4%.

67. The method according to any one of the preceding items 61-66, wherein the rotational speed is higher in the second conical reefing step than in the first conical refining step.

68. The method according to any one of the preceding items 61-67, wherein the flow through the at least one conical refiner in the first conical refining step is 40-140 l/s, such as 80-140 l/s, such as 100-120 l/s.

69. The method according to any one of the preceding items 61-68, wherein the flow through the at least one conical refiner in the second conical refining step is 50-80 l/s.

70. The method according to any one of the preceding items 61-69, wherein the specific edge load (SEL) is lower for the second conical refining step than for the first conical refining step.

71. The method according to any one of the preceding items 61-70, wherein the pulp is pretreated with alkali before the first conical refining step.

72. The method according to item 71, wherein the pH of the pulp in the alkali pretreatment is in the range of 8-11.

73. The method according to any one of the preceding items 60-72, wherein the pulp is pretreated with enzymes before the first conical refining step.

74. The method according to any one of items 71-73, wherein the pretreatment is carried out in a pretreatment vessel and wherein the average retention time of the pulp in the pretreatment vessel is between 20 min and 3 h, such as about 2 h.

75. The method according to any one of the preceding items 61-74, wherein the pulp is pre-refined before the first conical refining step, e.g. using a pre-refiner in which the net energy supply is in the range of 20-100 kWh/ton dry fibers, such as 25-45 kWh/ton dry fibers.

76. The method according to item 75, wherein the pre-refining is low consistency (LC) refining, e.g. using a conical refiner.

77. The method according to any one of the preceding items 61-76, wherein the pulp is bleached hardwood pulp, such as bleached birch pulp.

78. The method according to any one of the preceding items 61-77, wherein the first conical refining step comprises pulp cooling.

79. The method according to item 78, wherein a heat exchanger is used for the pulp cooling, which heat exchanger is arranged on a cooling circuit that is separate from a refining circuit on which the at least one conical refiner is arranged.

80. The method according to any one of the preceding items 61-79, wherein vibrations of a conical refiner of the first conical refining step is sensed and the load applied in the conical refiner of the first conical refining step is controlled in response to the sensed vibrations.

81. The method according to any one of the preceding items 61-80, wherein vibrations of a conical refiner of the second conical refining step is sensed and the load applied in the conical refiner is controlled in response to the sensed vibrations.

82. The method according to any one of the preceding items 61-81, wherein: the first conical refining step comprises circulating the pulp from a first tank, through the at least one conical refiner and back to the first tank; and/or the second conical refining step comprises circulating the pulp from a second tank, through the at least one conical refiner and back to the second tank, which second tank is preferably agitated by vertical circulation.

83. The method according to item 82, wherein the pulp from the first conical refining step is introduced into the second conical refining step in a position between an outlet of the tank and (an) inlet(s) of the at least one conical refiner.

84. The method according to item 82 or 83, wherein:

the first conical refining step comprises refining in at least two conical refiners arranged in parallel, which at least two conical refiners are preceded by a common pump; and/or the second conical refining step comprises refining in at least two conical refiners arranged in parallel, which at least two conical refiners are preceded by a common pump or one pump each.

85. The method according to any one of the preceding items 61-84, wherein the method is continuous.

86. The method according to item 85, wherein the rate of net energy transfer to the fibers of the pulp in the at least one conical refiner of the first conical refining step is controlled based on the flow rate of the pulp in the first conical refining step.

87. The method according to item 85 or 86, wherein the rate of net energy transfer to the fibers of the pulp in the at least one conical refiner of the second conical refining step is controlled based on the flow rate of the pulp in the second conical refining step.

88. The method according to items 82 and 85, wherein, in the first conical refining step, the flow through the at least one conical refiner is higher than the flow to the second conical refining step.

89. The method according to items 82 and 85, wherein, in the second conical refining step, the flow through the at least one conical refiner is higher than the flow of highly refined pulp from the second conical refining step.

90. The method according to item 82, wherein the pulp is introduced into the first conical refining step in a position between an outlet of the tank and (an) inlet(s) of the at least one conical refiner of the first conical refining step.

91. The method according to any one of items 61-84, wherein the method is batch-wise.

92. The method according to item 91, wherein the rate of net energy transfer to the fibers of the pulp in each of the at least one conical refiner of the first conical refining step is gradually decreased from a level of 900-1300 kW, such as about 1100 kW.

93. The method according to item 91 or 92, wherein the rate of net energy transfer to the fibers of the pulp in the at least one conical refiner of the second conical refining step is gradually decreased from a level of 900-1300 kW, such as about 1100 kW.

94. The method according to any one of items 91-93, wherein the retention time of the pulp in the first conical refining step is about 1 h and/or wherein the retention time of the pulp in the second conical refining step is about 1 h.

95. The method according to any one of the preceding items 61-94, wherein: the net energy supply in each of the at least one conical refiner of the first conical refining step is 200-600 kWh/tonne dry fibers, such as 300-500 kWh/tonne dry fibers; and/or the net energy supply in the at least one conical refiner of the second conical refining step is 200-600 kWh/tonne dry fibers, such as 300-500 kWh/tonne dry fibers.

96. The method according to any one of the preceding items 61-95, wherein the net energy supply is higher, such as at least 50% higher, in the at least one conical refiner of the first conical refining step is than in the at least one conical refiner of the second conical refining step.

97. The method according to any one of the preceding items 61-96, further comprising measuring a crill value and/or a fiber length value of the pulp and controlling a step of the method in response to the crill value and/or the fiber length value.

98. The method according to any one of the preceding items 61-96, further comprising the step of adding the highly refined pulp to a pulp for making paperboard and subsequently forming a middle layer of a multi-layered paperboard from a furnish comprising the pulp for making paperboard.

99. The method according to item 98, wherein the furnish comprises CTMP.

100. The method according to item 98, wherein the pulp for making paperboard comprises or consists of CTMP.

101. The method according to item 100, wherein the pulp for making paperboard is subjected to refining after the highly refined pulp has been added to it.

102. The method according to any one of the preceding items 61-101, further comprising the step of providing the highly refined pulp between two layers in a production of a multi-layered paperboard.

103. The method according to item 102, wherein the highly refined pulp is added to one of the two layers by spraying or by means of a headbox.

104. A system for producing a highly refined pulp, comprising:

a first refining arrangement comprising at least one conical refiner comprising refining plates having a bar width of 0.5-1.5 mm, such as about 1.0 mm, and a groove width of 1.0-2.0 mm, such as 1.4-2.0 mm, such as about 1.6 mm, provided that the groove width is greater than the bar width; and a second refining arrangement comprising at least one conical refiner comprising refining plates having a bar width of 0.5-1.5 mm, such as about 1.0 mm, and a groove width of 0.8-1.6 mm, such as 1.0-1.5 mm, wherein the second refining arrangement is connected to and arranged downstream of the first refining arrangement.

105. The system according to item 104, wherein the bar width in the second refining arrangement is about the same as the bar width in the first refining arrangement.

106. The system according to item 104 or 105, wherein the groove width in the second refining arrangement is smaller than the groove width in the first refining arrangement.

107. The system according to any one of items 104-106, wherein the bar height in the first refining arrangement is 3-10 mm, such as 5-6 mm.

108. The system according to any one of items 104-107, wherein the bar height in the second refining arrangement is 3-10 mm, such as 5-6 mm.

109. The system according to any one of items 104-108, further comprising a pre-refiner connected to and arranged upstream of the first refining arrangement, which pre-refiner may be a conical refiner.

110. The system according to item 109, wherein the pre-refiner comprises refining plates comprising refining plates having a bar width of at least 1.4 mm, such as at least 1.6 mm.
111. The system according to item 109 or 110, wherein the pre-refiner is a low consistency (LC) refiner.
112. The system according to any one of item 104-111, wherein the first refining arrangement comprises a heat-exchanger for cooling pulp.
113. The system according to any one of item 104-112, wherein the first refining arrangement comprises a cooling circuit on which the heat-exchanger is arranged and a refining circuit on which the at least one conical refiner is arranged, which cooling circuit is separate from the refining circuit.
114. The system according to any one of item 104-113, wherein a conical refiner of the first refining arrangement comprise(s) a sensor for sensing vibrations, which sensor can produce a signal that can be used to adjust the load applied in the conical refiner.
115. The system according to any one of item 104-114, wherein a conical refiner of the second refining arrangement comprises a sensor for sensing vibrations, which sensor ca produce a signal that can be used to adjust the load applied in the conical refiner.
116. The system according to any one of item 104-115, wherein the first refining arrangement comprises a first tank having a tank outlet and at least one tank inlet, wherein the tank outlet is connected to at least one inlet of the at least one conical refiner of the first refining arrangement and the at least one tank inlet is connected to at least one outlet of the at least one conical refiner of the first refining arrangement.
117. The system according to item 116, wherein a pump is arranged in the connection between the tank outlet and the at least one inlet of the at least one conical refiner.
118. The system according to any one of item 104-117, wherein the second refining arrangement comprises a second tank having a tank outlet and at least one tank inlet, wherein the tank outlet is connected to at least one inlet of the at least one conical refiner of the second refining arrangement and the at least one tank inlet is connected to at least one outlet of the at least one conical refiner of the second refining arrangement.
119. The system according to item 118, wherein a pump is arranged in the connection between the tank outlet and the at least one inlet of the at least one conical refiner.
120. The system according to item 118 or 119, wherein a lower portion of the second tank has a conical shape and wherein the tank outlet is provided at the bottom of the second tank.
121. The system according to any one of items 118-120, wherein the second tank comprises means for vertical circulation.
122. The system according to any one of item 104-121, further comprising a tank connected to and arranged downstream of the second refining arrangement.

DESCRIPTION

Figure 1:
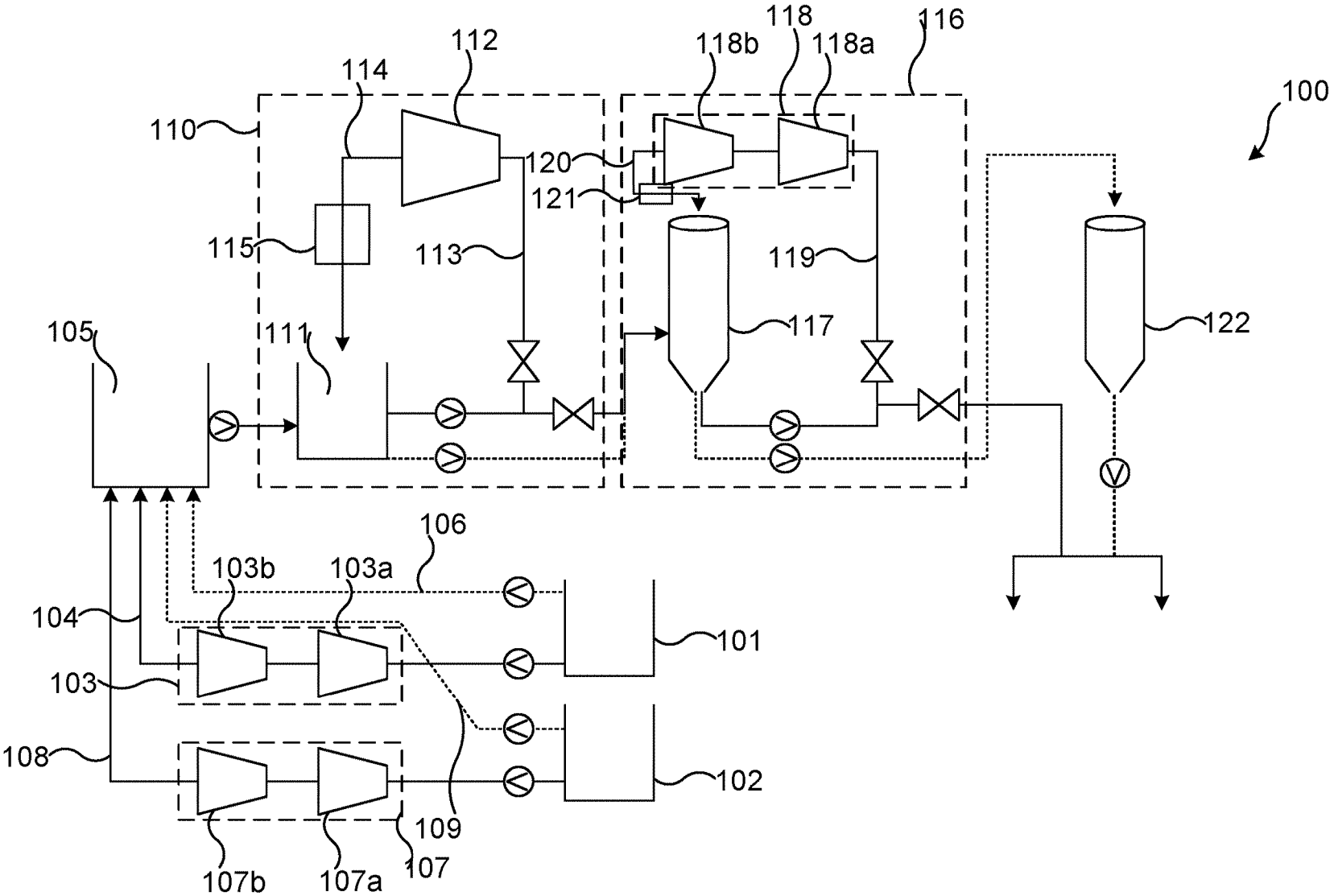
FIG. 1 illustrates a system for carrying out an embodiment of a method according to the present disclosure.

As a first aspect of the present disclosure, there is provided a method of producing a highly refined pulp, comprising the steps of:

providing a pulp;

subjecting the pulp to a first conical refining step in a conical refiner comprising refining plates having a bar width of 0.5-1.5 mm and a groove width of 0.5-1.5 mm; and subjecting the pulp from the first conical refining step to a second conical refining step in at least one conical refiner comprising refining plates having a bar width of 0.4-1.0 mm, such as 0.5-1.0 mm and a groove width of 0.4-1.0 mm, such as 0.5-1.0 mm to obtain the highly refined pulp.

It is understood that the pulp of the present disclosure is a cellulosic pulp. Preferably, the pulp comprises at least 75% virgin fibers, such as at least 90% virgin fibers, derived from wood. The pulp may for example be a hardwood pulp, such as a birch pulp. The hardwood pulp is preferably bleached. Alternatively, the pulp may be a softwood pulp. The softwood pulp may be bleached or unbleached. Bleached hardwood pulp, such as bleached birch pulp, is a particularly preferred type of pulp.

The bar width of the second conical refining step is preferably smaller than the bar width of the first conical refining step. As an example, the bar width of the first conical refining step may be about 1.0 mm, whereas the bar width of the second conical refining step is about 0.6 mm.

Similarly, the groove width of the second conical refining step is preferably smaller than the groove width of the first conical refining step. As an example, the groove width of the first conical refining step may be about 1.0 mm, whereas the groove width of the second conical refining step is about 0.6 mm.

In both the first and the second conical refining step, the bar height may be 3-10 mm, preferably 5-6 mm.

The rotational speed may be higher in the second conical reefing step than in the first conical refining step.

The specific edge load (SEL) is normally lower in the second conical refining step than in the first conical refining step.

The consistency of the pulp in the first and the second conical refining step is typically 2-5% and preferably about 4%. After the second conical refining step, the highly refined pulp may be diluted to a consistency of 0.5-1.5%. Thereby, pumping of the highly refined pulp is facilitated.

The flow through the conical refiners in the first and the second conical refining steps is typically 20-70 l/s.

To facilitate the refining in the conical refining steps, the pulp may be pretreated before the first conical refining step, e.g. with alkali or enzymes.

In case of alkali, the pH of the pulp in the pretreatment is preferably in the range of 8-11.

Various enzymatic pretreatments for facilitating fiber disintegration, e.g. fibrillation, have been described in the art and can be used for the method of the present disclosure.

The pretreatment may be carried out in a pretreatment vessel. This vessel may also be a dosing tank. The average retention time of the pulp in the pretreatment vessel may for example be between 20 min and 3 h, such as about 2 h.

Before the first conical refining step, the pulp may be subjected to pre-refining, typically at a consistency of 2-5%

(preferably about 4%). If pretreatment is carried out, the pre-refining is preferably carried out before the pretreatment. The pre-refining is typically carried out in at least one LC refiner, which may be of the type that is commonly used in papermaking. Pre-refining is particularly beneficial in case of softwood pulp. The Schopper Riegler (SR) number after the pre-refining may be 20-30, such as 21-25. The SR number is preferably measured according to ISO 5267-1: 1999.

The conical refining steps generate heat. Therefore, the first and/or second conical refining step may comprise cooling of the pulp.

The vibrations of the conical refiner of the first conical refining step may be sensed and the load applied in the conical refiner of the first conical refining step may be controlled in response to the sensed vibrations. Thereby, contact between the rotor and the stator of in the conical refiner can be avoided. The load applied in the conical refiner(s) of the second conical refining step can be controlled in the same way.

The first conical refining step preferably comprises circulating the pulp from a first tank, through the conical refiner and back to the first tank. A first loop is thus created, which allows pulp in the first conical refining step to pass through the conical refiner many times.

In the same way, the second conical refining step preferably comprises circulating the pulp from a second tank, through the at least one conical refiner and back to the second tank. A second loop is thus created, which allows pulp in the second conical refining step to pass through the conical refiner(s) many times.

In the second conical refining step, the viscosity of the pulp is normally high. Therefore, the second tank may have a standpipe design that facilitates withdrawal of pulp from it. The bottom portion of the second tank may have a conical shape and the outlet of the second tank is preferably provided at the very bottom. The pulp in the second tank may be agitated by vertical circulation. In an embodiment of such a vertical circulation, one part of the vertically circulated pulp is returned to the top of the tank and another part of the vertically circulated pulp is returned to the tank at a position just above the conical bottom portion. The first tank may have the same design.

In one embodiment, the method is continuous, which means that the first and the second conical refining step are carried out in a continuous fashion. In such an embodiment, the net energy transfer to the fibers of the pulp in the conical refiner of the first conical refining step is typically 500-1000 kW, such as 600-950 kW. Normally, the net energy transfer is held at a constant level in the continuous method. In the context of the present disclosure, the "net" energy transfer excludes the energy transfer needed to run the conical refiner with water only.

The rate of net energy transfer to the fibers of the pulp in the at least one conical refiner of the second conical refining step is also typically 500-1000 kW, such as 600-950 kW, when the method is continuous.

In the first conical refining step of the continuous method, the flow through the conical refiner is preferably higher than the flow to the second conical refining step. Similarly, the flow through the at least one conical refiner in the second conical refining step of the continuous method is higher than the flow of highly refined pulp from the second conical refining step. Thereby, pulp is allowed to pass through the conical refiners several times.

In both the first and the second conical refining step of the continuous method, a suitable average retention time of the pulp is between 20 min and 3 h, preferably about 1 h.

In another embodiment, the method is carried out batch-wise, which means that the first conical refining step is one batch process and the second conical refining step is another batch process.

In the batch of the first conical refining step, the load applied in the conical refiner is preferably gradually decreased. The load may for example be controlled based on vibrations sensed in the conical refiner, a crill value and/or a fiber length value (further discussed below) and/or the time elapsed since the batch started. As an example, the rate of net energy transfer to the fibers of the pulp in the conical refiner of the first conical refining step is gradually decreased from a level of 900-1300 kW, such as about 1100 kW. In one embodiment, the rate is lowered when a value corresponding to vibrations sensed in the conical refiner is above a reference. Since the load-bearing capacity of the pulp is decreased by the refining (and the vibrations increase when the load-bearing capacity is increased), such as control mechanism leads to a gradual decrease of the load applied in the conical refiner (because reduced energy transfer means reduced load).

Also in the batch of the second conical refining step, the load applied in the at least one conical refiner is preferably gradually decreased. The load may be controlled as discussed above. As an example, the rate of net energy transfer to the fibers of the pulp in the at least one conical refiner of the second conical refining step is gradually decreased from a level of 900-1300 kW, such as about 1100 kW.

In both the first and the second conical refining step of the batch-wise method, a suitable retention time of the pulp is between 20 min and 3 h, preferably about 1 h.

Independent of if the method is continuous or batch-wise, the net energy supply in the conical refiner of the first conical refining step is typically 300-1000 kWh/tonne dry fibers, such as 300-700 kWh/tonne dry fibers. Similarly, the net energy supply in the at least one conical refiner of the second conical refining step is typically 300-1000 kWh/tonne dry fibers, such as 300-700 kWh/tonne dry fibers. In the context of the present disclosure, the "net" energy supply excludes the energy supply needed to run the conical refiner with water only.

The method may comprise the one or more step(s) of measuring a crill value and/or a fiber length value of the pulp and controlling another method step in response to the crill value and/or the fiber length value. As mentioned above, the load applied in the first and/or second conical refining step may be controlled based on such (a) value(s). Another option is to control the degree of pretreatment. Examples of pretreatment parameters that can be controlled are residence time of the pulp, pH (in case of alkali pretreatment) and enzyme concentration. Yet another option is to control the pre-refining is response to a crill value and/or a fiber length value measured downstream the pre-refining, but upstream the first conical refining step.

The fiber length value may for example fines content value. "Fines" may be defined as fibers having a length below 0.2 mm. However, there are also other definitions of fines that can be used.

The highly refined pulp produced by the method is preferably used in the making of paper board. As an example, the highly refined pulp may be added to a pulp that is used in the formation of a middle layer of a multi-layered paperboard. Such a middle layer preferably comprises CTMP.

In one embodiment, the pulp to which the highly refined pulp is added comprises or consists of CTMP. Such an addition is preferably carried out before a step of refining the CTMP as the refining step efficiently mixes the highly refined pulp with the CTMP. The mechanical impact of the refiner may even "bind" the highly refined pulp to the CTMP, which is a relatively weak type of pulp. Thereby, stronger bonds between CTMP fibers and the other type of fibers in the middle layer are facilitated.

The highly refined pulp may also be provided between two layers in a production of a multi-layered paperboard. As an example, the highly refined pulp may be added to one of the two layers by spraying or by means of a headbox.

As a second aspect of the present disclosure, there is provided a system for producing a highly refined pulp. The system comprises:

a first refining arrangement comprising a conical refiner comprising refining plates having a bar width of 0.5-1.5 mm, such as about 1.0 mm, and a groove width of 0.5-1.5 mm, such as about 1.0 mm; and a second refining arrangement comprising at least one conical refiner comprising refining plates having a bar width of 0.4-1.0 mm, such as 0.5-1.0 mm, such as about 0.6 mm, and a groove width of 0.4-1.0 mm, such as 0.5-1.0 mm, such as about 0.6 mm, wherein the second refining arrangement is connected to and arranged downstream of the first refining arrangement.

The system of the second aspect may be used to carry out the method of the first aspects. The embodiments of the first aspect apply to the second aspect mutatis mutandis. Still, some embodiments of the second aspect are discussed below. These apply to the first aspect mutatis mutandis.

The system may comprise a dosing tank connected to and arranged upstream of the first refining arrangement. Such a dosing tank is of particularly beneficial in case of batch-wise production. As discussed above, a pretreatment of the pulp may be carried out in the dosing tank. Alternatively, a separate pretreatment tank is provided.

Further, the system may comprise at least one pre-refiner arranged upstream the first refining arrangement. If the dosing tank is included, the at least one pre-refiner is normally connected to and arranged upstream of the dosing tank.

A conical refiner of the first or second refining arrangement may comprise a sensor for sensing the conical refiner's vibrations. Such as sensor generates a signal that can be used to adjust the load applied in the conical refiner. Typically, the load is reduced if the vibrations signal is too high (e.g. above a reference value).

The first refining arrangement may comprises a first tank having a tank outlet and a tank inlet, wherein the tank outlet is connected to an inlet of the conical refiner of the first refining arrangement and the tank inlet is connected to an outlet of the conical refiner of the first refining arrangement. The first tank and the conical refiner thus form part of a circuit through which pulp may be looped. This circuit may also comprise a cooler.

Similarly, the second refining arrangement may comprises a second tank having a tank outlet and a tank inlet, wherein the tank outlet is connected to an inlet of the at least one conical refiner of the second refining arrangement and the tank inlet is connected to an outlet of the at least one conical refiner of the second refining arrangement. The second tank and the at least one conical refiner thus form part of a circuit through which pulp may be looped. This circuit may also comprise a cooler.

A lower portion of the second tank preferably has a conical shape and the tank outlet is preferably provided at the bottom of the second tank (i.e. at the bottom of the conical part). The second tank may comprise means for vertical circulation.

In one embodiment, the system comprises a tank connected to and arranged downstream of the second refining arrangement. In such a tank, which is particularly beneficial in case of batch-wise production, the highly refined pulp may be collected before being used, e.g. in the making of paperboard. The tank preferably has the same design as the second tank discussed above.

As a third aspect of the present disclosure, there is provided a method of producing a highly refined pulp, comprising the steps of:

providing a pulp;

subjecting the pulp to a first conical refining step in at least one conical refiner comprising refining plates having a bar width of 0.5-1.5 mm, such as about 1.0 mm, and a groove width of 1.0-2.0 mm, such as 1.4-2.0 mm, such as about 1.6 mm; and subjecting the pulp from the first conical refining step to a second conical refining step in at least one conical refiner comprising refining plates having a bar width of 0.5-1.5 mm, such as about 1.0 mm, and a groove width of 0.8-1.6 mm, such as 1.0-1.5 mm, to obtain the highly refined pulp.

Below, embodiments of the third aspect are described.

Preferably, the groove width is greater than the bar width in the first conical refining step. Thereby, deposits in the grooves may be reduced, in particular in case of refining of hardwood pulp, such as birch pulp. As an example, the groove width may be at least 20% greater, such as at least 40% greater, than the bar width in the first conical refining step.

The groove width of the second conical refining step is typically smaller than the groove width of the first conical refining step, while the bar width of the second conical refining step may be about the same as the bar width of the first conical refining step.

The bar height of the first and the second conical refining step may be 3-10 mm, such as 5-6 mm.

The consistency of the pulp in the first and the second conical refining step is typically 2-5%, such as about 4%.

Normally, (a) larger conical refiner(s) is/are used in the first step than in the second step. Accordingly, the rotational speed may be higher in the second conical reefing step than in the first conical refining step.

The flow through the at least one conical refiner in the first conical refining step may be 40-140 l/s, such as 80-140 l/s, such as 100-120 l/s. In case of two parallelly arranged conical refiners in the first step, the flow through each of them may thus be 20-70 l/s, such as 40-70 l/s, such as 50-60 l/s.

The flow through the at least one conical refiner in the second conical refining step may be 50-80 l/s. In case of two parallelly arranged conical refiners in the second step, the flow through each of them may thus be 25-40 l/s.

Preferably, the flow through the at least one conical refiner in the first conical refining step is higher than the flow through the at least one conical refiner in the second conical refining step, such as at least 20% higher, such as at least 40% higher.

Further, the specific edge load (SEL) may be lower for the second conical refining step than for the first conical refining step.

The pulp may be pretreated with alkali or enzymes before the first conical refining step. This is further discussed above in connection to the first aspect.

Preferably, the pulp is pre-refined before the first conical refining step. For the pre-refining step, a conical LC refiner may be used. The net energy supply in the pre-refining step may be in the range of 20-100 kWh/ton dry fibers, such as 25-45 kWh/ton dry fibers. Thereby, the downstream refining may be facilitated.

The Schopper Riegler (SR) number after the pre-refining may be 20-30, such as 21-25. The SR number is preferably measured according to ISO 5267-1:1999.

The pulp may be any type of wood pulp. Preferably, it is hardwood pulp, such as birch pulp. The hardwood pulp is preferably bleached.

The first conical refining step preferably comprises pulp cooling, e.g. using a heat exchanger. The heat exchanger may be arranged on a cooling circuit that is separate from a refining circuit on which the at least one conical refiner of the first step is arranged. Here, two circuits are considered to be "separate" even though they start and end in a common tank. Accordingly, the pulp in the tank may be refined in the refining circuit and cooled in the cooling circuit.

In one embodiment, no cooling is carried out in the second conical refining step.

The vibrations of a conical refiner of the first or the second conical refining step may be sensed and the load applied in the conical refiner may be controlled in response to the sensed vibrations. This is further discussed above in connection to the first aspect.

As indicated above, the first conical refining step preferably comprises circulating the pulp from a first tank, through the at least one conical refiner and back to the first tank. Typically, such a circulation is forced by a pump arranged in a connection between an outlet of the first tank and (an) inlet(s) of the at least one conical refiner.

Likewise, the second conical refining step preferably comprises circulating the pulp from a second tank, through the at least one conical refiner and back to the second tank. Typically, such a circulation is forced by a pump arranged in a connection between an outlet of the second tank and (an) inlet(s) of the at least one conical refiner.

The pulp from the first conical refining step is preferably introduced into the second conical refining step in a position between an outlet of the tank 209 and (an) inlet(s) of the at least one conical refiner. Thereby, all parts of the highly refined pulp in the tank have passed the at least one conical refiner of the second conical refining step at least once.

Likewise, the optionally pre-refined pulp transferred to the first conical refining step is preferably introduced into the first conical refining step in a position between an outlet of the tank and (an) inlet(s) of the at least one conical refiner. Thereby, all parts of the pulp in the tank of the first conical refining step have passed the at least one conical refiner of the first conical refining step at least once.

The second tank may be agitated by vertical circulation.

To obtain sufficient refining capacity, the first conical refining step may comprise refining in at least two conical refiners arranged in parallel. A single, common pump may be arranged upstream the at least two conical refiners of the first step.

Likewise, the second conical refining step may comprise refining in at least two conical refiners arranged in parallel. A single, common pump may be arranged upstream the at least two conical refiners of the second step.

The method of the third aspect is preferably continuous. In such case, the flow through the at least one conical refiner of the first conical refining step is preferably higher than the flow to the second conical refining step. Further, in the second conical refining step, the flow through the at least one conical refiner is preferably higher than the flow of highly refined pulp from the second conical refining step.

However, the method of the third aspect may also be batch-wise. In such case, the rate of net energy transfer to the fibers of the pulp in each of the at least one conical refiner of the first conical refining step may be gradually decreased from a level in the range of 900-1300 kW, such as about 1100 kW, to a level in the range of 50-200 kW, such as about 100 kW. Further, the rate of net energy transfer to the fibers of the pulp in the at least one conical refiner of the second conical refining step may be gradually decreased from a level in the range of 900-1300 kW, such as about 1100 kW, to a level in the range of 50-200 kW, such as about 100 kW.

The retention time of the pulp in the first conical refining step may be about 1 h. Likewise, the retention time of the pulp in the second conical refining step may be about 1 h.

The net energy supply in each of the at least one conical refiner of the first conical refining step may be 200-600 kWh/tonne dry fibers, such as 300-500 kWh/tonne dry fibers.

Further, the net energy supply in the at least one conical refiner of the second conical refining step may be 200-600 kWh/tonne dry fibers, such as 300-500 kWh/tonne dry fibers.

The net energy supply is preferably higher, such as at least 50% higher, in the at least one conical refiner of the first conical refining step is than in the at least one conical refiner of the second conical refining step.

The method of the third aspect may further comprise measuring a crill value and/or a fiber length value of the pulp and controlling a step of the method in response to the crill value and/or the fiber length value. This is further discussed above in connection to the first and second aspects.

Also, the method of the third aspect may further comprise the step of adding the highly refined pulp to a pulp for making paperboard and subsequently forming a middle layer of a multi-layered paperboard from a furnish comprising the pulp for making paperboard. This is further discussed above in connection to the first and aspects.

The embodiments of the first and second aspect thus apply to the third aspect mutatis mutandis.

As a fourth aspect of the present disclosure, there is provided a system for producing a highly refined pulp, comprising:

- a first refining arrangement comprising at least one conical refiner comprising refining plates having a bar width of 0.5-1.5 mm, such as about 1.0 mm, and a groove width of 1.0-2.0 mm, such as 1.4-2.0 mm, such as about 1.6 mm, wherein the groove width is preferably greater than the bar width; and
- a second refining arrangement comprising at least one conical refiner comprising refining plates having a bar width of 0.5-1.5 mm, such as about 1.0 mm, and a groove width of 0.8-1.6 mm, such as 1.0-1.5 mm, wherein the second refining arrangement is connected to and arranged downstream of the first refining arrangement.

The embodiments of the first, second and (in particular) third aspect apply to the fourth aspect mutatis mutandis.

Example 1

FIG. 1 illustrates a system 100 for carrying out an exemplary embodiment of a method of producing a highly refined pulp according to the present disclosure. The starting pulp may be either softwood pulp or hardwood pulp, such as birch pulp. The pulp may be unbleached or bleached. The hardwood (e.g. birch) pulp is typically bleached. FIG. 1 illustrates one tank 101 for unbleached or bleached softwood pulp and another tank 102 for bleached hardwood pulp, such as bleached birch pulp. In practice, however, only one type of pulp is normally used, which means that two parallel tanks 101, 102 are not necessary.

If the pulp is softwood pulp, it is preferably subjected to pre-refining 103, e.g. by two low consistency (LC) refiners 103*a*, 103*b* arranged in series. The pre-refined pulp, which may have a SR value of 21-25, is then routed 104 to a dosing tank 105. Alternatively, pre-refining is omitted and the softwood pulp is routed 106 directly to the dosing tank 105.

If the pulp is bleached hardwood pulp, it may be subjected to pre-refining 107, e.g. by two low consistency (LC) refiners 1*o*7*a*, 107*b* arranged in series. The pre-refined pulp is then routed 108 to the dosing tank 105. Alternatively, pre-refining is omitted and the hardwood pulp is routed 109 directly to the dosing tank 105.

The consistency of the pulp in the dosing tank 105 is typically 2-5% and preferably about 4%. The average retention time of the pulp in the dosing tank 105 may for example be in the range of 20 min to 3 h, such as 1-3 h. The pulp may be subjected to pretreatment, e.g. by enzymes or alkali, in the dosing tank 105 to facilitate downstream refining. Suitable enzymes for pretreating pulp before disintegration/fibrillation are known to the skilled person. In case of alkali pretreatment, the amount of alkali added to the pulp is preferably such that the pulp obtains a pH value in the range of 8-11. The enzymes or the alkali is preferably added to the pulp in a mixer (not shown) arranged upstream the dosing tank 105, which means that the addition takes place when the pulp is routed 104, 106, 108, 109 to the dosing tank 105. Alternatively, the pretreatment may be carried out in a separate tank (not shown) arranged upstream or downstream the dosing tank 105. Such a separate tank is preferably designed for a pulp retention time of 20 min to 3 h.

The pulp from the dosing tank 105 or the separate pretreatment tank is then subjected to a first conical refining step in a first refining arrangement 110 comprising a tank 111 and conical refiner 112. Normally, the consistency is still 2-5% (preferably about 4%). The refining plates of the conical refiner 112 have a bar width of 0.5-1.5 mm (preferably about 1.0 mm) and a groove width of 0.5-1.5 mm (preferably about 1.0 mm). The bar height is typically 3-10 mm (preferably 5-6 mm). The flow through the conical refiner 112, which may be a JC-04 refiner (Valmet), is typically 20-70 l/s. The rotational speed of the conical refiner 112 may for example be 400-1000 rpm. The volume of tank 111 is preferably such that the retention time of the pulp in the first conical refining step may be at least one hour.

Piping 113 connects an outlet of the tank 111 to an inlet of the conical refiner 112. Another piping 114 connects an outlet of the conical refiner 112 to an inlet of the tank 111. A cooler 115 may be arranged on this piping 114. Together, the tank 111 the conical refiner 112 and the pipings 113, 114 create a loop for several passes through the conical refiner 112.

If the method is continuous, a first flow from the tank 111 is looped through the conical refiner 112 and a second flow, which is smaller than the first flow, is routed to a second refining arrangement 116. In the case of a continuous method, the rate of net energy transfer to the fibers of the pulp in the conical refiner 112 is normally held constant, e.g. at a level of 500-1000 kW, such as 600-950 kW.

If the method is carried out batch-wise, pulp is looped through the conical refiner 112 for a predetermined period of time, until a certain degree of refining has been reached or until refining cannot be carried anymore without risking contact between the bars of the opposed refining plates in the conical refiner 112. Such contact can be avoided by sensing the vibrations of the conical refiner 112 and controlling the load applied in the conical refiner in response thereto. In the case of a batch-wise method, the rate of net energy transfer to the fibers of the pulp in the conical refiner 112 is preferably decreased gradually from a level of 900-1300 kW, such as about 1100 kW. This means that the highest load is applied in the beginning of the batch and that the load is then gradually decreased when the pulp's ability to carry load is reduced. At the end of the batch, the rate of net energy transfer to the fibers of the pulp in the conical refiner 112 may be about 100 kW. The time need for one batch may be 1-3 h, such as about 1 h.

The net energy supply in the conical refiner 112 of the first conical refining step is normally in the range of 300-1000 kWh/tonne dry fibers.

The pulp from the first refining arrangement 110 is then subjected to a second conical refining step in the second refining arrangement 116 comprising a tank 117 (that preferably has a conical bottom) and at least one conical refiner 118. Normally, the consistency is still 2-5% (preferably about 4%). The refining plates of the at least one conical refiner 118 have a bar width of 0.5-1.0 mm (preferably about 0.6 mm) and a groove width of 0.5-1.0 mm (preferably about 0.6 mm). The bar height is typically 3-10 mm (preferably 5-6 mm). The flow through the at least one conical refiner 118, which may for example be two JC03 refiners (Valmet) 118*a*, 118*b* arranged in series, is typically 20-70 l/s. In case of two such refiners 118*a*, 118*b*, each of them may for example be operated at a rotational speed of 1000 rpm or higher. If there is instead a single refiner in this position, it is typically larger and operates at a rotational speed below 1000 rpm. The volume of tank the 117 is preferably such that the retention time of the pulp in the second conical refining step may be at least one hour.

Piping 119 connects a preferably vertical outlet at the bottom of the tank 117 to an inlet of the at least one conical refiner 118. Another piping 120 connects an outlet of the at least one conical refiner 118 to an inlet at the top of the tank 117. A cooler 121 may be arranged on this piping 120. The tank 117, the at least one conical refiner 118 and the pipings 119, 120 together create a loop for several passes through the at least one conical refiner 118.

If the method is continuous, a first flow from the tank 117 is looped through the at least one conical refiner 118 and a second flow (of highly refined pulp), which is smaller than the first flow, leaves the second refining arrangement 116. In the case of a continuous method, the rate of net energy transfer to the fibers of the pulp in the at least one conical refiner 118 is normally held constant, e.g. at a level of 500-1000 kW, such as 600-950 kW.

If the method is carried out batch-wise, pulp is looped through the at least one conical refiner 118 for a predetermined period of time, until a certain degree of refining has been reached or until refining cannot be carried out anymore without risking contact between the bars of the opposed refining plates in the at least one conical refiner 118. Such contact can be avoided by sensing the vibrations of the at least one conical refiner 118 and controlling the load applied in the conical refiner(s) in response thereto. In the case of a batch-wise method, the rate of net energy transfer to the fibers of the pulp in the at least one conical refiner 118 is preferably decreased gradually from a level of 900-1300 kW, such as about 1100 kW. This means that the highest load is applied in the beginning of the batch and that the load is then gradually decreased when the pulp's ability to carry load is reduced. At the end of the batch, the rate of net energy transfer to the fibers of the pulp in the at least one conical refiner 118 may be about 100 kW. The time need for one batch may be 1-3 h, such as about 1 h.

The net energy supply in the at least one conical refiner 118 of the second conical refining step is normally in the range of 300-1000 kWh/tonne dry fibers.

The highly refined pulp from the second conical refining step may be diluted to a consistency of about 1% to facilitate pumping.

The highly refined pulp from the second conical refining step may then be used in the production of paperboard. It may for example be added to a pulp intended for a middle layer of a multi-layered paperboard. A purpose of such an addition may be to allow for an increased amount of CTMP (or another relatively "weak" pulp) in the middle layer without a reduction in the z-strength of the middle layer. It may be preferred to add the highly refined pulp directly to a CTMP before the CTMP is mixed with other pulps. Preferably, the CTMP is subjected to refining after the addition of the highly refined pulp.

Another option is to use the highly refined pulp as an "adhesive" between two layers of a multi-layered paperboard (to improve "ply-bond strength"). In such case, the highly refined pulp may be added by means of a head box or be spraying to a first fibre web, which is then couched together with a second fibre web.

Before being routed to the paperboard production process, the highly refined pulp may be collected in a tank 122 from which the highly refined pulp is then pumped to the paperboard production process. The use of such a tank 122 is normally necessary when the production of the highly refined pulp is carried out batch-wise. The bottom of the collection tank 122 preferably has a conical shape with the outlet provided at the very bottom of the cone. The inlet of the collection tank 122 is preferably arranged at the top. In case of continuous production of the highly refined pulp, the collection tank 122 may be omitted.

A fibre crill value and/or at least one fibre length value may be measured in the loop of the first and/or the second conical refining step. Such value(s) are indicative of the degree of refining and can thus be used to control the load applied in the conical refiners 112, 118 of said steps. A PulpEye can be used for the measurements. As an example, the PulpEye may be used to measure the fines content, while it fails to detect fibre structures that are smaller than fines. In a batch-wise process, the first and in particular the second conical refining step may thus be continued until the fines content is below a pre-determined threshold value.

A fibre crill value and/or at least one fibre length value may also be measured after the pre-refining 103 and the degree of pre-refining may be adjusted in response to the measured value(s). Similarly, one or both of these fibre parameters may be measured after the pretreatment in the dosing tank 105 and a pretreatment condition such as enzyme concentration, pH or residence time may be adjusted in response to the measured parameter(s).

Example 2

Figure 2:
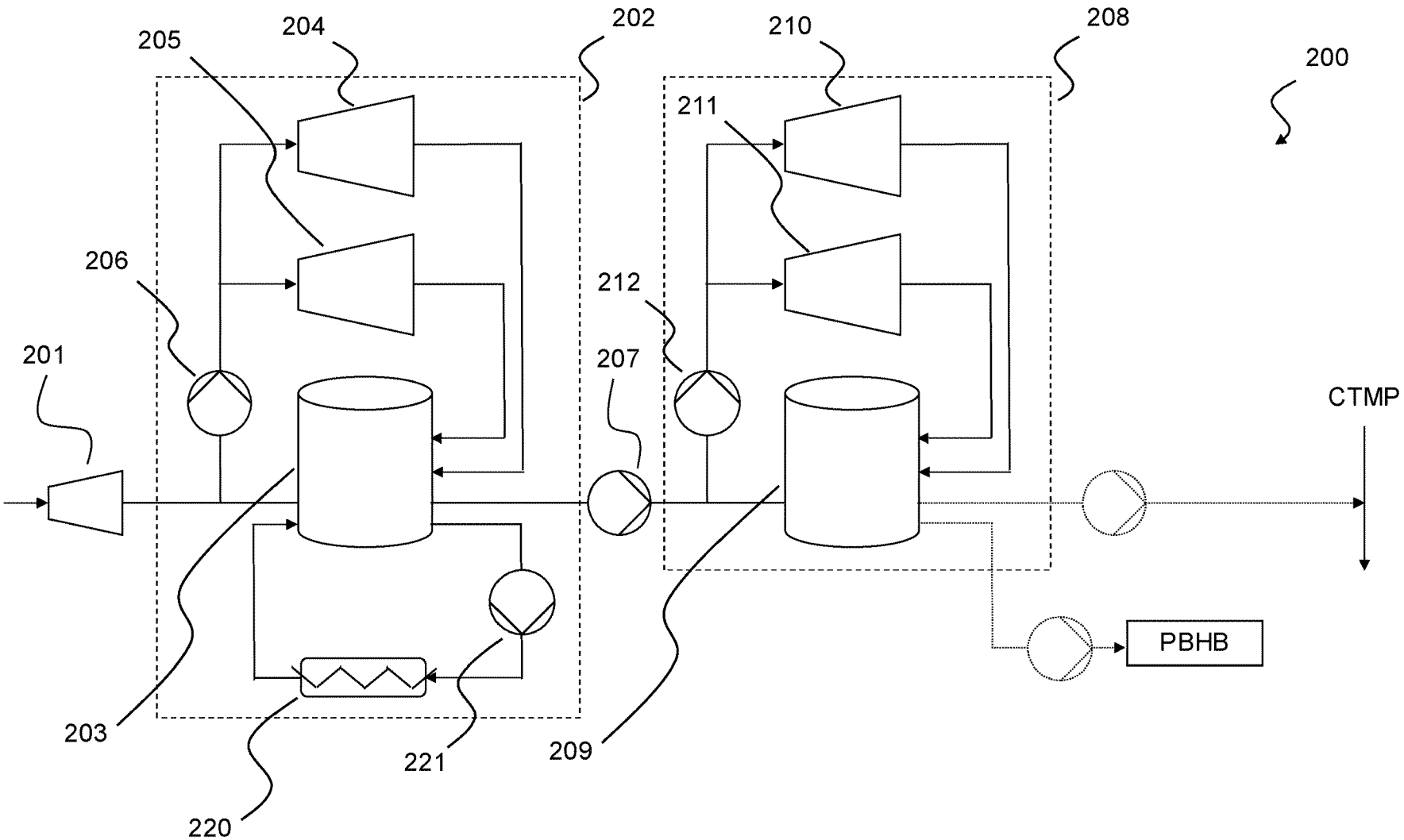
FIG. 2 illustrates a system for carrying out an embodiment of another method according to the present disclosure.

FIG. 2 illustrates a system 200 for carrying out an exemplary embodiment of a method of producing a highly refined pulp according to the present disclosure. The starting pulp may be either softwood pulp or hardwood pulp, such as birch pulp. The pulp may be unbleached or bleached. The hardwood (e.g. birch) pulp is typically bleached.

The pulp is preferably subjected to pre-refining, e.g. by a low consistency (LC) refiner 201. The consistency of the pulp subjected to pre-refining is typically 2-5% and preferably about 4%. A typical SR value of the pre-refined pulp is 20-30.

The LC refiner 201 of the pre-refining may be a conical refiner. The conical refiner may be relatively small. For example, it may be a JC-01 refiner (Valmet) or a JC-02 refiner (Valmet). The refining plates of the LC refiner of the pre-refining typically have a bar width of at least 1.4 mm, such as at least 1.6 mm. The specific edge load (SEL) of the pre-refining step is typically below 1. The pre-refiner may cut the fibers of the pulp (i.e. reduce the average fiber length) to facilitate the downstream refining steps.

The optionally pre-refined pulp is subjected to a first conical refining step in a first refining arrangement 202, which comprises a tank 203 and at least two conical refiners 204, 205. The conical refiners 204, 205, which may be JC-04 refiners (Valmet), are preferably arranged in parallel because the pressure drop over a refiner is significant. Pulp may be supplied to such parallelly arranged conical refiners 204, 205 by means of a common pump 206. That means that the flow from the outlet of the pump 206 is split into at least two flows to serve the at least two conical refiners 204, 205. Normally, the consistency is still 2-5% (preferably about 4%) in the conical refiners 204, 205. The refining plates of the conical refiners 204, 205 have a bar width of 0.5-1.5 mm (preferably about 1.0 mm) and a groove width of 1.0-2.0 mm (preferably about 1.6 mm). Wider grooves (e.g. 1.4-2.0 mm results in less depositions, in particular in case of hardwood pulp). The bar height is typically 3-10 mm (preferably 5-6 mm). The flow through each of the conical refiners 204, 205 is typically 20-70 l/s, such as 50-60 l/s. Accordingly, the total flow in the first conical refining step may for example be 100-120 l/s. The SEL of each of the conical refiners 204, 205 is typically 0.10-0.40, such as 0.25-0.35. The rotational speed of each of the conical refiners 204, 205 may for example be 400-1000 rpm.

The inlet of the pump 206 is connected to an outlet of the tank 203. Further, the outlets of the conical refiners 204, 205 are connected to inlet(s) of the tank 203. Together, the tank 203, the conical refiners 204, 205 and the connections therebetween (including the pump 206) create a loop for several passes through the conical refiners 204, 205.

Further, an outlet of the tank 203 is connected to a heat exchanger 220 for pulp cooling and an outlet of the heat exchanger 220 is connected to an inlet of the tank 203. Hence, the pulp may be circulated from the tank 203, through the heat exchanger 220 and back to the tank 203 to cool the pulp of the first conical refining step. The circulation is forced by a pump 221 arranged between the outlet of the tank 203 and the inlet of the heat exchanger 220. Such an arrangement of the heat exchanger 220 (i.e. on a separate loop) is beneficial since there is a significant pressure drop over the heat exchanger 220.

If the method is continuous, a first flow from the tank 203 is looped through the conical refiners 204, 205 and a second flow, which is smaller than the first flow, is routed to a second refining arrangement 207. In the case of a continuous method, the rate of net energy transfer to the fibers of the pulp in the conical refiners 204, 205 is normally dependent on the flow and thus held constant given a constant flow.

If the method is carried out batch-wise, pulp is looped through the conical refiners 204, 205 for a predetermined period of time, until a certain degree of refining has been reached or until refining cannot be carried anymore without risking contact between the bars of the opposed refining plates in the conical refiners 204, 205. Such contact can be avoided by sensing the vibrations of the conical refiners 204, 205 and controlling the load applied in the conical refiner in response thereto. In the case of a batch-wise method, the rate of net energy transfer to the fibers of the pulp in the conical refiners 204, 205 may be decreased gradually from a level of 900-1300 kW, such as about 1100 kW. This means that the highest load is applied in the beginning of the batch and that the load is then gradually decreased when the pulp's ability to carry load is reduced. At the end of the batch, the rate of net energy transfer to the fibers of the pulp in the conical refiners 204, 205 may be about 100 kW. The time needed for one batch may be 1-3 h, such as about 1 h.

The net energy supply in each of the conical refiners 204, 205 of the first conical refining step is normally in the range of 150-600 kWh/tonne dry fibers, such as about 400 kWh/tonne dry fibers.

The pulp from the first refining arrangement 201 is then transferred (by means of a pump 207) to a second refining arrangement 208 and subjected to a second conical refining step. The second refining arrangement 208 comprises a tank 209 and at least one conical refiner, such as a single conical refiner (e.g. a JC-04 (Valmet)) or two parallelly arranged conical refiners 210, 211 (e.g. two parallelly arranged JC03 refiners (Valmet)). Parallel arrangement is beneficial because of the significant pressure drop over a refiner, especially in the second step in which the viscosity is higher. Normally, the consistency is still 2-5% (preferably about 4%). The refining plates of the at least one conical refiner have a bar width of 0.5-1.5 mm (preferably about 1.0 mm) and a groove width of 0.8-1.6 mm (preferably 1.0-1.5 mm). The bar height is typically 3-10 mm (preferably 5-6 mm). The flow through the at least one conical refiner is typically 50-80 l/s. In case of two parallelly arranged conical refiners 210, 211, the flow through each of them may thus be 25-40 l/s. Further, in case of two conical refiners 210, 211, each of them may for example be operated at a rotational speed of 1000 rpm or higher. If there is instead a single refiner in this position, it is typically larger (e.g. the JC-04) and operates at a rotational speed below 1000 rpm.

Pulp is supplied to the at least one conical refiner of the second refining arrangement 208 by means of a pump 212. In case of two parallelly arranged conical refiners 210, 211, this pump 212 may serve both refiners 210, 211. Hence, the pulp flow from the pump 212 may be divided into two flows. Alternatively, the parallelly arranged conical refiners 210 and 211 may have one pump each as the pressure drop is so high given the viscosity of the pulp and the fine surfaces of the refiner plates.

The pulp transferred from the first refining arrangement 201 is preferably introduced into the second refining arrangement 208 in a position between an outlet of the tank 209 and (an) inlet(s) of the at least one conical refiner. Thereby, all parts of the highly refined pulp in the tank 209 have passed the at least one conical refiner of the second refining arrangement 208 at least once.

Likewise, the optionally pre-refined pulp transferred to the first refining arrangement 201 is preferably introduced into the first refining arrangement 201 in a position between an outlet of the tank 203 and (an) inlet(s) of the refiners 204, 205. Thereby, all parts of the pulp in the tank 203 have passed at least one of the refiners 204, 205 at least once.

The inlet of the pump 212 is connected to an outlet of the tank 209. Further, the outlet(s) of the conical refiner(s) of the second refining arrangement 208 are connected to inlet(s) of the tank 209. Together, the tank 209, the conical refiner(s) and the connections therebetween (including the pump 212) create a loop for several passes through the conical refiner (s).

The capacity of the heat exchanger 220 of the first refining arrangement 202 may be such that no cooling of the pulp in the second refining arrangement 208 is necessary, especially if the energy transfer to the pulp in the second conical refining step is lower than in the first conical refining step (less energy transfer means development of less heat). Further, it is advantageous to avoid cooling in the second refining arrangement because the viscosity of the pulp is very high therein (which make cooling in a heat-exchanger difficult).

If the method is continuous, a first flow from the tank 209 is looped through the at least one conical refiner and a second flow (of highly refined pulp), which is smaller than the first flow, leaves the second refining arrangement 208.

In the case of a continuous method, the rate of net energy transfer to the fibers of the pulp in the at least one conical refiner is normally dependent on the flow and thus held constant given constant flow.

If the method is carried out batch-wise, pulp is looped through the at least one conical refiner of the second refining arrangement 208 for a predetermined period of time, until a certain degree of refining has been reached or until refining cannot be carried out anymore without risking contact between the bars of the opposed refining plates in the at least one conical refiner. Such contact can be avoided by sensing the vibrations of the at least one conical refiner and controlling the load applied in the conical refiner(s) in response thereto. In the case of a batch-wise method, the rate of net energy transfer to the fibers of the pulp in the at least one conical refiner is preferably decreased gradually from a level of 900-1300 kW, such as about 1100 kW. This means that the highest load is applied in the beginning of the batch and that the load is then gradually decreased when the pulp's ability to carry load is reduced. At the end of the batch, the rate of net energy transfer to the fibers of the pulp in the at least one conical refiner may be about 100 kW. The time need for one batch may be 1-3 h, such as about 1 h.

The net energy supply in the at least one conical refiner of the second conical refining step is normally in the range of 200-800 kWh/tonne dry fibers, such as 300-500 kWh/tonne. In case of two parallelly arranged conical refiners 210, 211, the net energy supply in each refiner is normally in the range of 150-300 kWh/tonne dry fibers, such as about 200 kWh/tonne.

The highly refined pulp from the second conical refining step may be diluted to a consistency of about 1% to facilitate pumping.

The highly refined pulp from the second conical refining step may then be used in the production of paperboard. It may for example be added to a pulp intended for a middle layer of a multi-layered paperboard. A purpose of such an addition may be to allow for an increased amount of CTMP (or another relatively "weak" pulp) in the middle layer without a reduction in the z-strength of the middle layer. It may be preferred to add the highly refined pulp directly to a CTMP before the CTMP is mixed with other pulps. Preferably, the CTMP is subjected to refining after the addition of the highly refined pulp.

Another option is to use the highly refined pulp as an "adhesive" between two layers of a multi-layered paperboard (to improve "ply-bond strength"). In such case, the highly refined pulp may be added by means of a head box (e.g. a ply bond head box, "PBHB") or be sprayed to a first fibre web, which is then couched together with a second fibre web. In the latter case, the MFC may comprise an additive to improve the sprayability.

Before being routed to the paperboard production process, the highly refined pulp may be collected in a tank from which the highly refined pulp is then pumped to the paperboard production process. The use of such a tank is normally necessary when the production of the highly refined pulp is carried out batch-wise. The bottom of the collection tank preferably has a conical shape with the outlet provided at the very bottom of the cone. The inlet of the collection tank is preferably arranged at the top. In case of continuous production of the highly refined pulp, the collection tank may be omitted.

A fibre crill value and/or at least one fibre length value may be measured in the loop of the first and/or the second conical refining step. Such value(s) are indicative of the degree of refining and can thus be used to control the load applied in the conical refiners 112, 118 of said steps. A PulpEye can be used for the measurements. As an example, the PulpEye may be used to measure the fines content, while it fails to detect fibre structures that are smaller than fines. In a batch-wise process, the first and in particular the second conical refining step may thus be continued until the fines content is below a pre-determined threshold value.

A fibre crill value and/or at least one fibre length value may also be measured after the pre-refining and the degree of pre-refining may be adjusted in response to the measured value(s).

The invention claimed is:

1. A method of producing a refined pulp, comprising the steps of:

providing a pulp;

subjecting the pulp to a first conical refining step in at least one conical refiner comprising refining plates having a bar width of 0.5-1.5 mm, and a groove width of 1.0-2.0 mm; and subjecting the pulp from the first conical refining step to a second conical refining step in at least one conical refiner comprising refining plates having a bar width of 0.5-1.5 mm, and a groove width of 0.8-1.6 mm, to obtain the refined pulp;

wherein:

the groove width is greater than the bar width in the first conical refining step, the groove width of the second conical refining step is smaller than the groove width of the first conical refining step, the pulp is bleached hardwood pulp, and the consistency of the pulp in the first and the second conical refining step is 2-5%.

2. The method according to claim 1, wherein the flow through the at least one conical refiner in the first conical refining step is 40-140 l/s, the flow through the at least one conical refiner in the second conical refining step is 50-80 l/s, and the flow through the flow through the at least one conical refiner in the first conical refining step is at least 40% higher than the flow through the at least one conical refiner in the second conical refining step.

3. The method according to claim 1, wherein the pulp is pre-refined before the first conical refining step.

4. The method according to claim 1, wherein the first conical refining step comprises pulp cooling by means of a heat exchanger.

5. The method according to claim 4, wherein the heat exchanger is arranged on a cooling circuit that is separate from a refining circuit on which the at least one conical refiner is arranged.

6. The method according to claim 1, wherein the second conical refining step comprises no pulp cooling by means of a heat exchanger.

7. The method according to claim 1, wherein:

the first conical refining step comprises circulating the pulp from a first tank, through the at least one conical refiner and back to the first tank; and the second conical refining step comprises circulating the pulp from a second tank, through the at least one conical refiner and back to the second tank, which second tank is agitated by vertical circulation.

8. The method according to claim 7, wherein the pulp from the first conical refining step is introduced into the second conical refining step in a position between an outlet of the second tank and (an) inlet(s) of the at least one conical refiner.

9. The method according to claim 7, wherein:

the first conical refining step comprises refining in at least two conical refiners arranged in parallel, which at least two conical refiners are preceded by a common single pump; and/or the second conical refining step comprises refining in at least two conical refiners arranged in parallel, which at least two conical refiners are preceded by a common single pump or one pump each.

10. The method according to claim 7, wherein the pulp is introduced into the first conical refining step in a position between an outlet of the first tank and (an) inlet(s) of the at least one conical refiner of the first conical refining step.

11. The method according to claim 1, wherein the method is continuous.

12. The method according to claim 1, wherein the net energy supply in the at least one conical refiner of the first conical refining step is 400-1000 kWh/tonne dry fibers, the net energy supply in the at least one conical refiner of the second conical refining step is 200-600 kWh/tonne dry fibers, and the net energy supply is at least 50% higher in the at least one conical refiner of the first conical refining step than in the at least one conical refiner of the second conical refining step.

13. A method for making paperboard, comprising providing the refined pulp of claim 1, and adding the refined pulp to a pulp for making paperboard and subsequently forming a middle layer of a multi-layered paperboard from a furnish comprising the pulp for making paperboard.

14. The method according to claim 13, wherein the furnish comprises CTMP.

15. The method according to claim 13, wherein the pulp for making paperboard comprises or consists of CTMP.

16. The method according to claim 15, wherein the pulp for making paperboard is subjected to refining after the refined pulp has been added to it.

17. The method according to claim 13, further comprising the step of providing the refined pulp between two layers in a production of a multi-layered paperboard.

18. A method of producing a highly refined pulp, comprising the steps of:

providing a pulp;

subjecting the pulp to a first conical refining step in a conical refiner comprising refining plates having a bar width of 0.5-1.5 mm, and a groove width of 0.5-1.5 mm; and subjecting the pulp from the first conical refining step to a second conical refining step in at least one conical refiner comprising refining plates having a bar width of 0.5-1.0 mm, and a groove width of 0.5-1.0 mm, to obtain the highly refined pulp; and wherein:

the groove width is greater than the bar width in the first conical refining step, the groove width of the second conical refining step is smaller than the groove width of the first conical refining step, the pulp is bleached hardwood pulp, and the consistency of the pulp in the first and the second conical refining step is 2-5%.

19. The method according to claim 18, wherein the bar width of the second conical refining step is smaller than the bar width of the first conical refining step and wherein the groove width of the second conical refining step is smaller than the groove width of the first conical refining step.

20. The method according to claim 18, wherein the rotational speed is higher in the second conical reefing step than in the first conical refining step.

21. The method according to claim 18, wherein the pulp is pretreated with alkali or enzymes before the first conical refining step.

22. The method according to claim 18, wherein:

the first conical refining step comprises circulating the pulp from a first tank, through the conical refiner and back to the first tank; and the second conical refining step comprises circulating the pulp from a second tank, through the at least one conical refiner and back to the second tank.

23. A method of making paperboard, comprising providing the refined pulp of claim 18, and adding the refined pulp to a pulp for making paperboard and subsequently forming a middle layer of a multi-layered paperboard from a furnish comprising the pulp for making paperboard.

24. The method of claim 23, wherein the pulp for making paperboard comprises or consists of CTMP.

25. The method of claim 23, further comprising the step of providing the refined pulp between two layers in a production of a multi-layered paperboard.

26. A system for producing a refined pulp, comprising:

a first refining arrangement comprising at least one conical refiner comprising refining plates having a bar width of 0.5-1.5 mm, and a groove width of 1.0-2.0 mm, wherein the groove width is preferably greater than the bar width; and a second refining arrangement comprising at least one conical refiner comprising refining plates having a bar width of 0.5-1.5 mm, and a groove width of 0.8-1.6 mm, wherein the second refining arrangement is connected to and arranged downstream of the first refining arrangement;

wherein the groove width is greater than the bar width in the first refining arrangement, and the groove width of the second refining arrangement is smaller than the groove width of the first refining arrangement.

27. A system for producing a refined pulp, comprising:

a first refining arrangement comprising a conical refiner comprising refining plates having a bar width of 0.5-1.5 mm, and a groove width of 0.5-1.5 mm; and a second refining arrangement comprising at least one conical refiner comprising refining plates having a bar width of 0.5-1.0 mm, and a groove width of 0.5-1.0 mm, wherein the second refining arrangement is connected to and arranged downstream of the first refining arrangement; and wherein the groove width is greater than the bar width in the first refining arrangement, and the groove width of the second refining arrangement is smaller than the groove width of the first refining arrangement.

* * * * *